US008556187B1

(12) United States Patent
Darcy

(10) Patent No.: US 8,556,187 B1
(45) Date of Patent: Oct. 15, 2013

(54) SYSTEM AND METHOD FOR OPERATING A COOLING LOOP

(75) Inventor: Jon Joseph Darcy, Park Ridge, NJ (US)

(73) Assignee: Coil Control, LLC, Keller, TX (US)

( * ) Notice: Subject to any disclaimer, the term of this patent is extended or adjusted under 35 U.S.C. 154(b) by 768 days.

(21) Appl. No.: 12/315,190

(22) Filed: Nov. 28, 2008

Related U.S. Application Data

(60) Provisional application No. 61/004,523, filed on Nov. 28, 2007.

(51) Int. Cl.
*F24F 3/14* (2006.01)
*B01F 3/02* (2006.01)
*F25B 49/00* (2006.01)

(52) U.S. Cl.
USPC ..... 236/44 C; 236/44 R; 62/176.1

(58) Field of Classification Search
USPC ..... 236/44 C, 44 R; 62/176.1, 176.4; 165/223
See application file for complete search history.

(56) References Cited

U.S. PATENT DOCUMENTS 2,072,166 A * 3/1937 Goodman ..... 165/207
4,399,864 A * 8/1983 Lamar ..... 165/229
4,512,161 A * 4/1985 Logan et al. ..... 62/176.6
5,675,979 A * 10/1997 Shah ..... 62/176.6
7,874,499 B2 * 1/2011 Lochtefeld ..... 236/44 C
2006/0010893 A1 * 1/2006 Dominguez ..... 62/201
2008/0310112 A1 * 12/2008 Long et al. ..... 361/701

FOREIGN PATENT DOCUMENTS

JP 06094285 A * 4/1994
JP 09166346 A * 6/1997

OTHER PUBLICATIONS

Althose/Turnquist/Bracciano, Modern Refrigeration and Air Conditioning; The Boodheart-Willcox Company, Inc., p. 729, 1996.*

* cited by examiner

*Primary Examiner* — Chen Wen Jiang
(74) *Attorney, Agent, or Firm* — Barnes & Thornburg LLP; Edward F. Behm, Jr.; Thomas J. McWilliams

(57) ABSTRACT

A system for operating a cooling loop associated with a space and including at least one cooling coil and cooling fluid supply, the system including: a grain sensor positioned with respect to the space and providing a value indicative of the amount of moisture in the space; at least one pump fluidly coupled across the coil; at least one flow limiter fluidly coupled to the coil and limiting a flow of cooling fluid between the cooling fluid supply and the coil; and at least one controller electrically coupled to the flow limiter; wherein, the at least one controller selectively operates the flow limiter responsive to the value indicative of the amount of moisture in the space and the pump re-circulates cooling fluid independent of the cooling fluid supply dependently upon the flow limiter.

18 Claims, 3 Drawing Sheets

SYSTEM AND METHOD FOR OPERATING A COOLING LOOP

RELATED APPLICATION

This application claims priority of U.S. patent application Ser. No. 61/004,523, entitled SYSTEM AND METHOD FOR OPERATING A CONTROL LOOP, filed Nov. 28, 2007, the entire disclosure of which is hereby incorporated by reference as if being set forth in its entirety herein.

FIELD OF THE INVENTION

The present invention relates generally to heating and cooling systems, and more particularly to heating and cooling systems incorporating a cooling coil and their operation.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts and in which.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in typical heating and cooling systems. However, because such elements are well known in the art, and because they do not facilitate a better understanding of the present invention, a discussion of such elements is not provided herein. The disclosure herein is directed to all such variations and modifications known to those skilled in the art.

Figure 1:
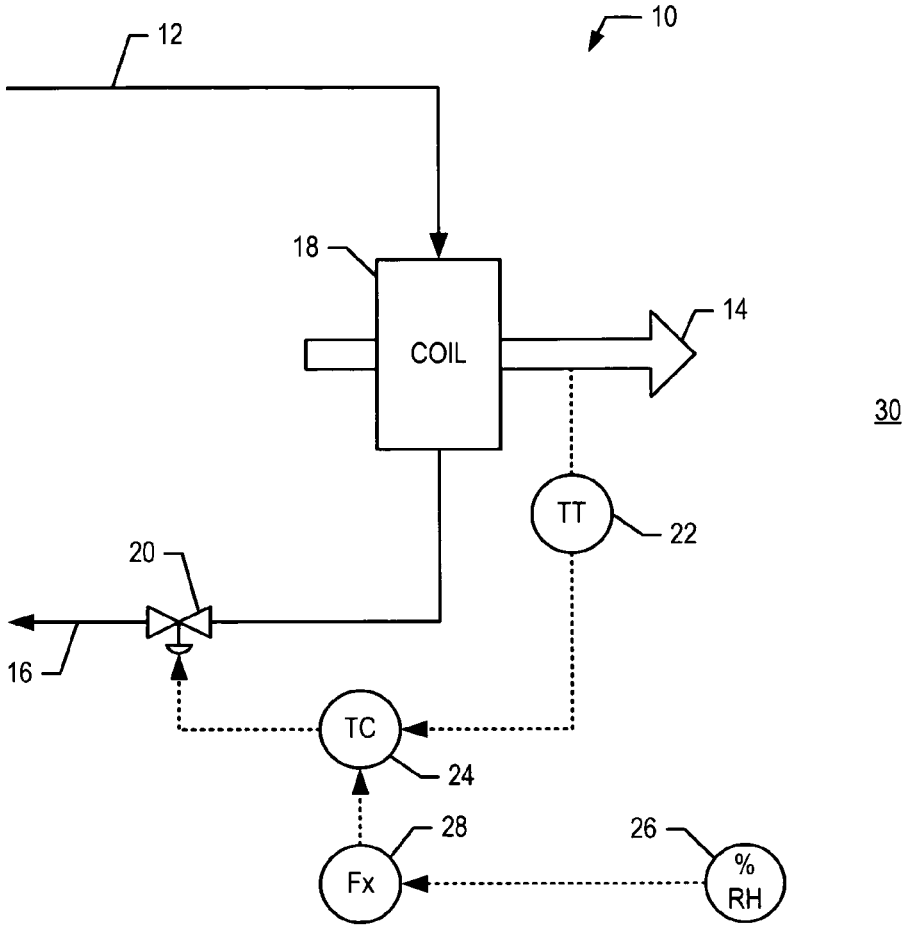
FIG. 1 illustrates a schematic representation of a system incorporating a cooling coil.

FIG. 1 shows a schematic representation of a chilled water system 10. System 10 receives chilled water via a supply line 12, and returns water that has been used to cool air 14 via line 16. Chilled water supply line 12 and chilled water return line 16 are interconnected via cooling coil 18. Basically, chilled water is supplied to system 10 via supply line 12. Supplied chilled water circulates through coil 18, where an air/water heat exchange occurs, leading to air 18 forced through coil 14 being cooled and the supplied chilled water being warmed. The warmed chilled water from coil 18 is returned for re-chilling by line 16. Chilled air 14 may be supplied to a space 30, such as a conventional space within a building serviced by system 10. Chilled water supply and return lines, and cooling coils, are well known to those possessing an ordinary skill in the pertinent arts.

Water flow through coil 18 is controlled via valve 20. While valve 20 is shown to be in line 14, it may be analogously situated in line 12. Either way, valve 20 may be used to throttle chilled water flow through coil 18, thereby controlling the cooling of air 14. The position of valve 20, and hence amount of cooling provided to air 14, is controlled by temperature controller 24, which is responsive to a conventional control algorithm (e.g., proportional-integral, or proportional-integral-derivative) and a temperature transmitter or sensor 22 and setpoint supplied by a setpoint generator 28. Temperature transmitter 22 provides a signal indicative of the temperature of air 14 after cooling by coil 18. Setpoint generator 28 provides a signal or value indicative of a temperature setpoint responsively to a percent relative humidity sensor 26. Sensor 26 provides a signal indicative of the percent relative humidity of space 30.

Controller 24 compares the temperature of air 14 to the setpoint, and modulates the position of valve 20 accordingly. In essence, if air 14 is too warm, valve 20 may be opened to provide more chilled water through coil 18, thereby providing more cooling. If air 14 is too cold, valve 20 may be partially closed, to provide less chilled water through coil 18, thereby providing less cooling. By way of non-limiting example only, a typical setpoint for air 14 temperature may be around 52 degrees Fahrenheit to around 58 degrees Fahrenheit, depending upon the relative humidity of space 30 and operator preference. Air 14 may be reheated prior to introduction to space 30, to around 70 degrees Fahrenheit to around 72 degrees Fahrenheit, depending upon operator preference.

Such a configuration may be subject to certain shortcomings. For example, as chilled water flow through coil 18 lessens, flow may become laminar in nature. In such an event, heat exchange with air 14 may become significantly reduced, and a threshold condition effected between where proper air 14 cooling does and doesn't occur. This leads to inefficient cycling of system 10.

Figure 2:
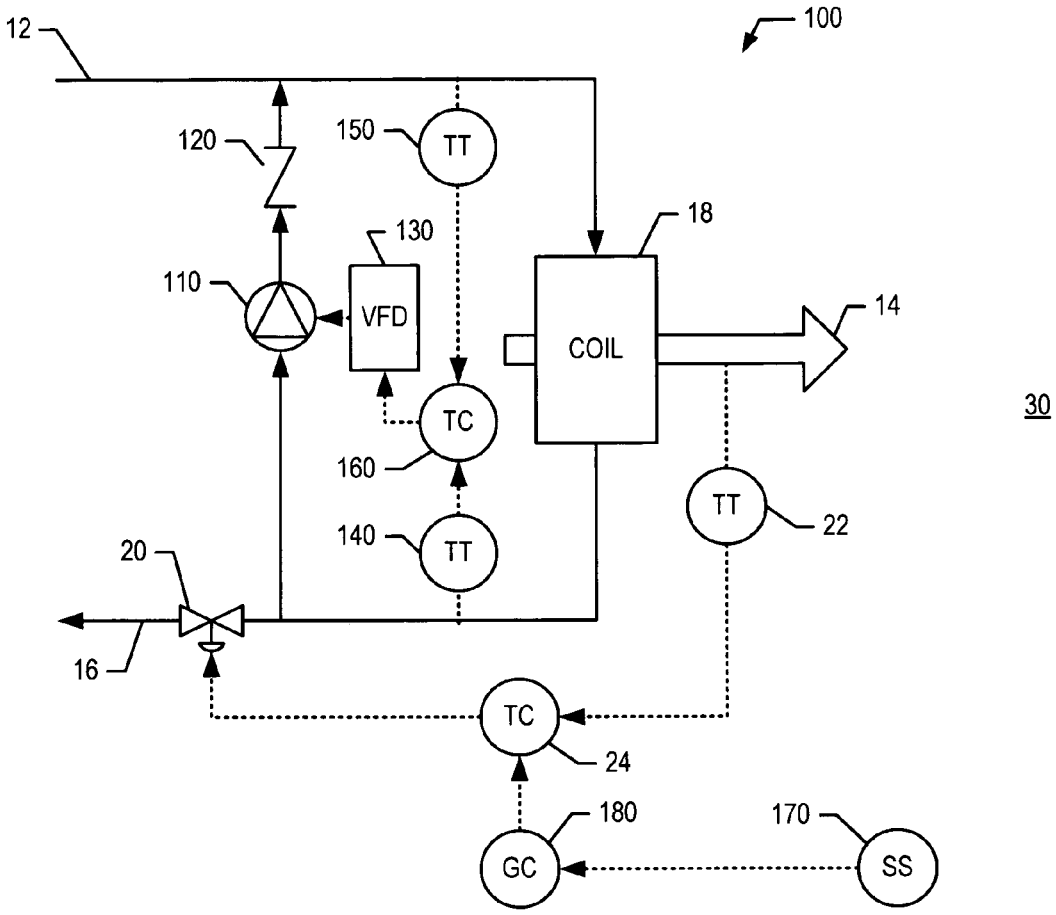
FIG. 2 illustrates a schematic representation of a system incorporating a cooling coil according to an embodiment of the present invention.

Referring now to FIG. 2, there is shown a schematic representation of a system 100 according to an embodiment of the present invention. Like elements in FIGS. 1 and 2 have been labeled with like reference for non-limiting sake of explanation.

System 100 additionally includes a coil re-circulating line 105. While line 105 is shown in conjunction with a single coil 18, it may analogously be coupled across a plurality of cooling coils, for example. Either way, recirculating line 105 connects chilled water return line 16 to chilled water supply line 12. In the illustrated embodiment of FIG. 2, recirculating line 105 connects to return line 116 upstream from valve 20.

In the embodiment of FIG. 2, recirculating line 105 includes a serially coupled pump 110 and check valve 120. Pump 110 serves to reintroduce warmed chilled water from coil 18 return line 14 to supply line 12, and coil 18. Pump 110 operates responsively to variable frequency drive (VFD) 130. Pump 110 and drive 130 may, in certain embodiments, be selected to provide around 120% of the full-load, design coil flow of coil 18. Check valve 120 serves to prevent chilled water from supply line 12 bypassing coil 18.

For non-limiting purposes of explanation only, it should be understood that cooling coils have a design temperature differential ($\Delta T_{design}$) between the chilled water supply line 12 and chilled water return line 16. The $\Delta T_{design}$ of a cooling coil is function of the original design of the entire chilled water system. An exemplary $\Delta T_{design}$ of a cooling coil may be around 10 degrees Fahrenheit to around 15 degrees Fahrenheit. Coil 18 operates efficiently (e.g., may be characterized as efficiently exchanging heat between chilled water and air) at $\Delta T_{design}$. As the actual temperature differential across a cooling coil ($\Delta T_{actual}$) varies from $\Delta T_{design}$ though, the coil efficiency may degrade. This may result from a number of factors, including the occurrence of laminar flow through coil 18, for example.

Referring still to FIG. 2, system 100 also includes temperature transmitters or sensors 140, 150. Temperature transmitters 140, 150 may take the form of commercially available platinum tip resistance temperature detectors (RTD's), for example. Temperature transmitter 140 provides a signal indicative of the temperature of water in chilled water return line 16, after passing through cooling coil 18. Temperature transmitter 150 provides a signal indicative of the temperature of water in chilled water supply line 12, prior to passing through cooling coil 18. While temperature transmitter 150 is shown in the embodiment of FIG. 2 downstream from recirculating line 105, it may optionally be positioned upstream from recirculating line 105 in supply line 12.

System 100 also includes a temperature controller 160 coupled to temperature transmitters 140, 150. Controller 160 determines an actual temperature differential $\Delta T_{actual}$ across coil 18 and compares it to $\Delta T_{design}$ of coil 18. Where controller 160 determines $\Delta T_{actual}<\Delta T_{design}$, it may signal VFD 130 to slow pump 110. Conversely, where controller 160 determines $\Delta T_{actual}>\Delta T_{design}$, it may signal VFD 130 to speed pump 110. In certain embodiments, controller 160 may take the form of a commercially available, digital proportional-integral controller.

Referring still to FIG. 2, system 200 also includes a space sensor 170. Space sensor 170 detects the relative humidity of space 30 (analogously to sensor 26), and additionally the temperature of space 30. Space sensor 170 is coupled to a grain controller 180.

Grain controller 180 serves to calculate the absolute humidity in space 30 responsively to sensor 170, such as by using a conventional psychometric-based approach. The absolute humidity may be expressed in grains of moisture/pound of dry air, for example. Regardless, grain controller 180 utilizes the determined absolute humidity of space 30, together with a predetermined desired absolute humidity, to establish a setpoint for controller 24. By way of non-limiting example, the desired absolute humidity may be around 64.5 grains of moisture/pound of dry air. Where the controller 180 determined absolute humidity is greater than 64.5 grains of moisture/pound of dry air, it may increase the temperature setpoint of controller 24. Analogously, where the controller 180 determined absolute humidity is less than 64.5 grains of moisture/pound of dry air, it may decrease the temperature setpoint of controller 24. As will be understood by those possessing an ordinary skill in the pertinent arts, the absolute humidity of space 30 is temperature independent, whereas the relative humidity of space 30 utilized in system 10 to determine a setpoint is temperature dependent.

In certain embodiments of the present invention, space sensor 170 may take the form of a temperature and humidity transmitter, such as those commercially available via Rotronic Instrument Corp., of Huntingdon, N.Y., and controller 180 may take the form of a commercially available, digital proportional-integral controller.

Controller 24 may throttle valve 20 in a manner analogous to system 10 responsively to air 14 temperature as determined by sensor 14 and the setpoint provided by grain controller 180. In certain embodiments of the present invention, temperature transmitter 22 may take the form of a commercially available platinum tip RTD's, and controller 24 may take the form of a commercially available, digital proportional-integral controller.

Figure 3:
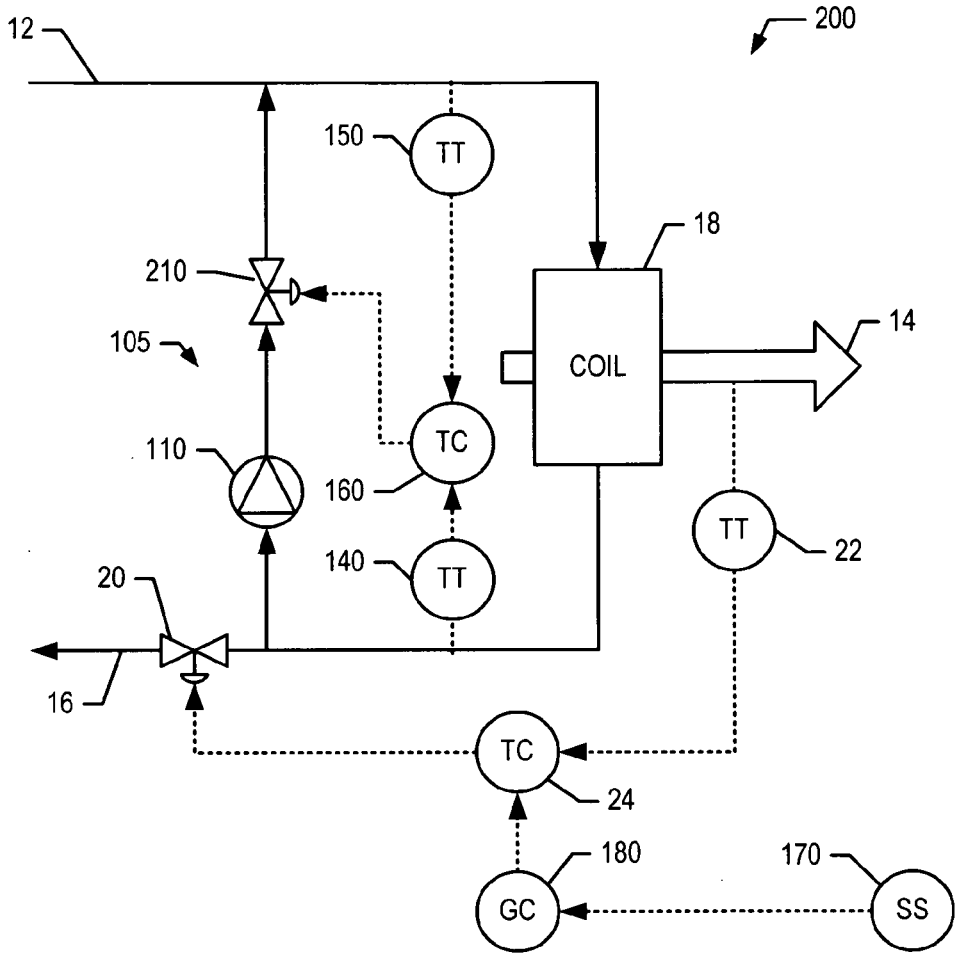
FIG. 3 illustrates a schematic representation of a system incorporating a cooling coil according to an embodiment of the present invention.

Referring now to FIG. 3, there is shown a schematic representation of a system 200 according to an embodiment of the present invention. Like elements in FIGS. 1, 2 and 3 have been labeled with like reference for non-limiting sake of explanation.

Different from the embodiment of FIG. 2, system 200 includes an additional valve 210. Controller 160 throttles flow through recirculating line 105 to achieve a similar result as the embodiment of FIG. 2.

It will be apparent to those skilled in the art that modifications and variations may be made without departing from the spirit or scope of the invention.

What is claimed is:

1. A method for operating a chilled water system servicing a space of a building, the chilled water system including a cooling coil interconnected to a chilled water supply, the method comprising:

determining a value substantially indicative of the absolute humidity of the building space, wherein air supplied to the building space is forced across the cooling coil such that heat is exchanged between the forced air and chilled water flowing through the cooling coil dependently upon a setpoint being responsive to a temperature and relative humidity of the building space, and chilled water flowing through the cooling coil in a laminar nature reduces the heat exchanged and a cooling efficiency associated with the building space; and mitigating occurrences of laminar flow through said cooling coil and the reduction in the cooling inefficiency by selectively recirculating at least part of the chilled water that flowed through the cooling coil through the cooling coil again independently of the chilled water supply and dependently upon the determined value substantially indicative of the absolute humidity of the building space.

2. The method of claim 1, further comprising selectively operating a variable speed pump that recirculates the chilled water dependently upon temperatures of chilled water entering and exiting the at least one coil.

3. The method of claim 1, further comprising determining a value substantially indicative of a value indicative of the temperature of air exiting the at least one cooling coil, wherein the selectively recirculating chilled water through the at least one cooling coil and independently of the supply is at least partially dependent upon the determined value substantially indicative of the absolute humidity of the space and the determined value substantially indicative of a value indicative of the temperature of air exiting the at least one cooling coil.

4. The method of claim 1, further comprising selectively returning chilled water exiting the at least one coil to the supply for re-chilling.

5. The method of claim 1, further comprising selectively restricting an amount of chilled water supplied by the supply prior to it entering the at least one cooling coil.

6. The method of claim 1, further comprising selectively re-heating air exiting the at least one cooling coil.

7. The method of claim 1, wherein the selective recirculation provides a greater load than the full load design coil flow of the at least one cooling coil.

8. The method of claim 1, further comprising preventing chilled water from bypassing the at least one cooling coil via a recirculating loop.

9. The method of claim 1, further comprising determining temperatures of chilled water entering and exiting the at least one coil, and modifying chilled water flow through the at least one cooling coil dependently upon the determined temperatures.

10. The method of claim 1, further comprising determining a value substantially indicative of the relative humidity of the space, wherein the determining a value substantially indicative of the absolute humidity of the space is dependent upon the determined value substantially indicative of the relative humidity of the space.

11. The method of claim 1, further comprising comparing a humidity setpoint to the determined value substantially indicative of the absolute humidity of the space.

12. The method of claim 11, determining a value substantially indicative of a value indicative of the temperature of air exiting the at least one cooling coil and selectively restricting an amount of chilled water supplied by the supply prior to it entering the at least one cooling coil dependently upon the determined value indicative of the temperature of air exiting the at least one cooling coil.

13. The method of claim 1, wherein the selective recirculation is at least partially proportional in nature.

14. The method of claim 13, wherein the selective recirculation is at least partially integral in nature.

15. The method of claim 14, wherein the selective recirculation is 2 at least partially derivative in nature.

16. The method of claim 1, wherein the selective recirculation comprises pumping.

17. The method of claim 1, wherein the selective recirculation comprises valving.

18. The method of claim 17, wherein the selective recirculation further comprises pumping.

* * * * *